US008672815B1

(12) United States Patent
Springer

(10) Patent No.: US 8,672,815 B1
(45) Date of Patent: Mar. 18, 2014

(54) BARBELL SYSTEM

(76) Inventor: Jonathan C. Springer, Conroe, TX (US)

( * ) Notice: Subject to any disclaimer, the term of this patent is extended or adjusted under 35 U.S.C. 154(b) by 292 days.

(21) Appl. No.: 13/292,552

(22) Filed: Nov. 9, 2011

(51) Int. Cl.
*A63B 23/16* (2006.01)
*A63B 21/072* (2006.01)
*A63B 71/00* (2006.01)

(52) U.S. Cl.
USPC ..... 482/106; 482/50; 482/139

(58) Field of Classification Search
USPC ..... 482/44–50, 92–98, 106–108, 139, 141, 482/908
See application file for complete search history.

(56) References Cited

U.S. PATENT DOCUMENTS 3,384,370 A 5/1968 Bailey et al.
4,618,143 A 10/1986 Twardosz
4,629,184 A 12/1986 Selkee
4,822,035 A * 4/1989 Jennings et al. ..... 482/106
5,080,349 A 1/1992 Vittone
6,022,300 A * 2/2000 Hightower ..... 482/106
D535,336 S 1/2007 Diakonov

OTHER PUBLICATIONS www.bestbuyfitness.com; USA Suprabar Curl Bar With Removable Handles; internet; Jul. 7, 2011.

* cited by examiner

*Primary Examiner* — Loan Thanh
*Assistant Examiner* — Jennifer M Deichl

(57) ABSTRACT

A barbell system having a center shaft with a first and second end, a first and second outer shaft, the ends telescopically received in an inner end of the outer shafts adjustable in length via a securing mechanism, retaining rings on outer ends of the outer shafts oriented in the same direction, each retaining ring having an outer ring, inner ring, a front and back surface which form an inner cavity, a track is in each inner ring extending through its entire circumference, a handle shaft having a first and second end which protrude through the track, a lip on both ends of the handle shaft to secure the ends within the inner cavity, bearings lining an internal surface of the inner ring and bearings lining an internal surface of each outer ring, and weight bearing shafts on the retaining rings opposite the outer shafts to removably engage a weight.

2 Claims, 4 Drawing Sheets

TOP VIEW

FRONT VIEW

BARBELL SYSTEM

FIELD OF THE INVENTION

The present invention is directed to a barbell system, more particularly to a barbell system with rotating handles and an adjustable length.

BACKGROUND OF THE INVENTION

Athletes commonly use standard barbells during workout sessions. The present invention features a novel barbell system. The system of the present invention features rotating handles and an adjustable length. The system of the present invention helps provide a better work out by allowing for biomechanically correct movements. The system also allows for many different exercises to be done with a single bar.

SUMMARY

The present invention features a barbell system. In some embodiments, the barbell system comprises a center shaft having a first end and a second end; a first outer shaft and a second outer shaft, the first end of the center shaft is telescopically received in an inner end of the first outer shaft and the second end of the center shaft is telescopically received in an inner end of the second outer shaft, the system is adjustable in length wherein the first outer shaft can be secured in a position with respect to the center shaft via a first securing mechanism and the second outer shaft can be secured in a position with respect to the center shaft via a second securing mechanism; a first retaining ring disposed on an outer end of the first outer shaft and a second retaining ring disposed on an outer end of the second outer shaft, the retaining rings are oriented in the same direction, each retaining ring comprises an outer ring to which the outer shafts are attached, an inner ring, a front surface, and a back surface that together form an inner cavity, wherein a track is disposed in each inner ring extending through its entire circumference; a handle shaft having a first end and a second end, the first end protrudes through the track in a first position and the second end of the handle shaft protrudes through the track in a second position opposite the first position, wherein a lip is disposed on both the first end of the handle shaft and on the second end of the handle shaft to secure the ends, of the handle shaft within the inner cavity of the retaining ring; first bearings lining an internal surface of the inner ring of each retaining ring and second bearings lining an internal surface of each outer ring, the lips of the handle shafts engage the first bearings and the ends of the handle shafts engage the second bearings; and a first weight bearing shaft disposed on the first retaining ring opposite the first outer shaft and a second weight bearing shaft disposed on the second retaining ring opposite the second outer shaft, the weight bearing shafts are adapted to removably engage a weight.

In some embodiments, the first securing mechanism or the second securing mechanism comprises a peg-and-aperture mechanism as shown.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Referring now to FIG. 1-5, the present invention features a barbell system 100. The barbell system 100 comprises a center shaft 110 having a first end 111 and a second end 112. The system 100 further comprises a first outer shaft 120*a* and a second outer shaft 120*b*. The first end 111 of the center shaft 110 is telescopically received in the inner end 121*a* of the first outer shaft 120*a* and the second end 112 of the center shaft 110 is telescopically received in the inner end 121*b* of the second outer shaft 120*b*.

The system 100 is adjustable in length. For example, the position of the first outer shaft 120*a* and the second outer shaft 120*b* on the center shaft 110 is adjustable. The first outer shaft 120*a* can be secured in a position with respect to the center shaft via a first securing mechanism 140*a*. The second outer shaft 120*b* can be secured in a position with respect to the center shaft via a second securing mechanism 140*b*. The securing mechanisms may comprise a peg-and-aperture mechanism as shown. Peg-and-aperture mechanisms are well known to one of ordinary skill in the art. The securing mechanisms are not limited to peg-and-aperture mechanisms.

Figure 1:
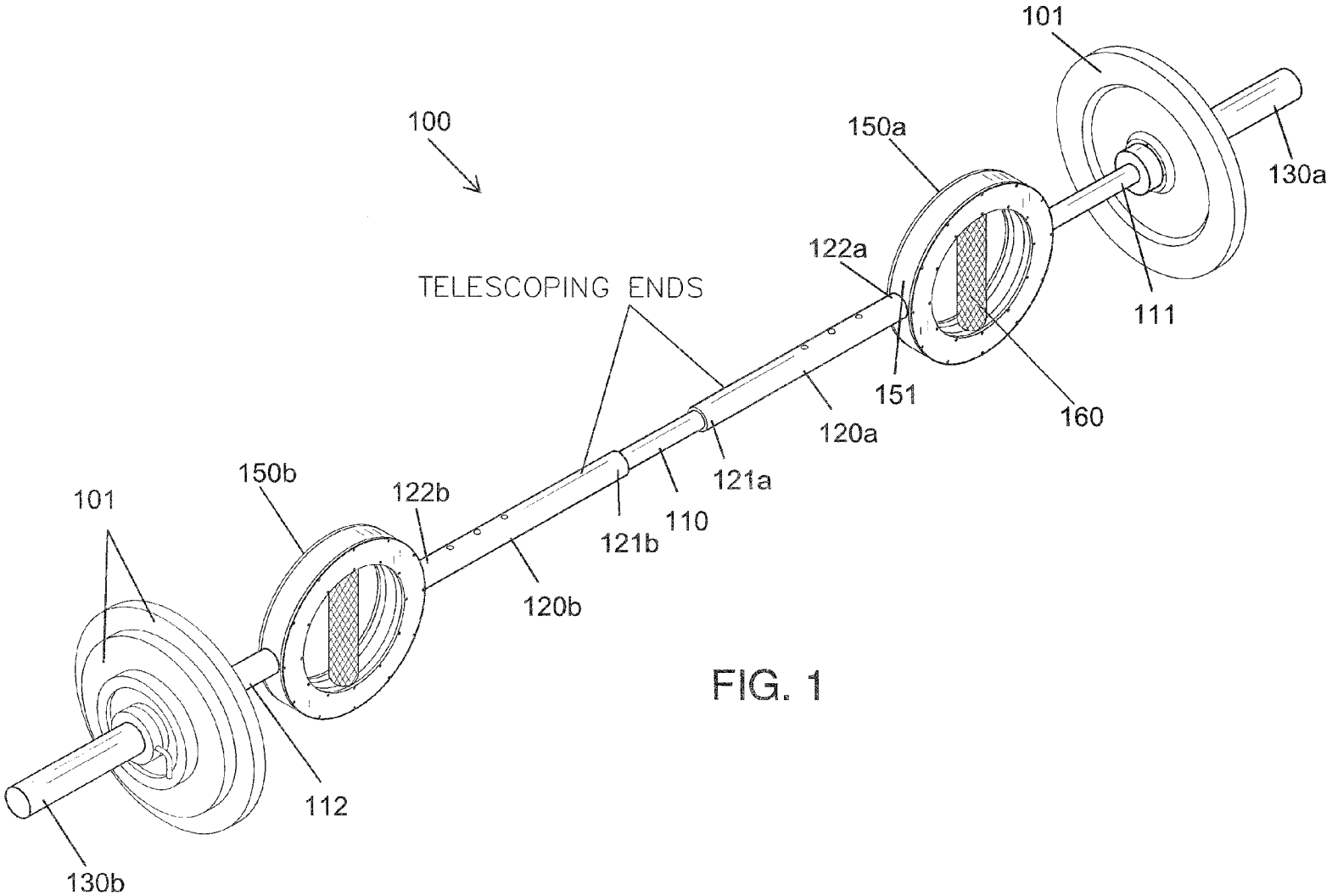
FIG. 1 is a perspective view of the barbell system of the present invention.
Figure 2:
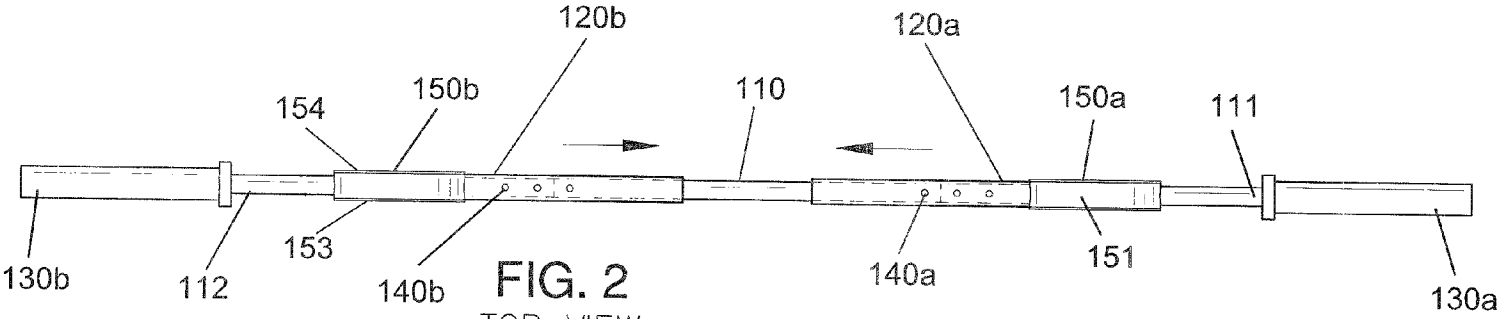
FIG. 2 is a top view of the barbell system of the present invention.
Figure 3:
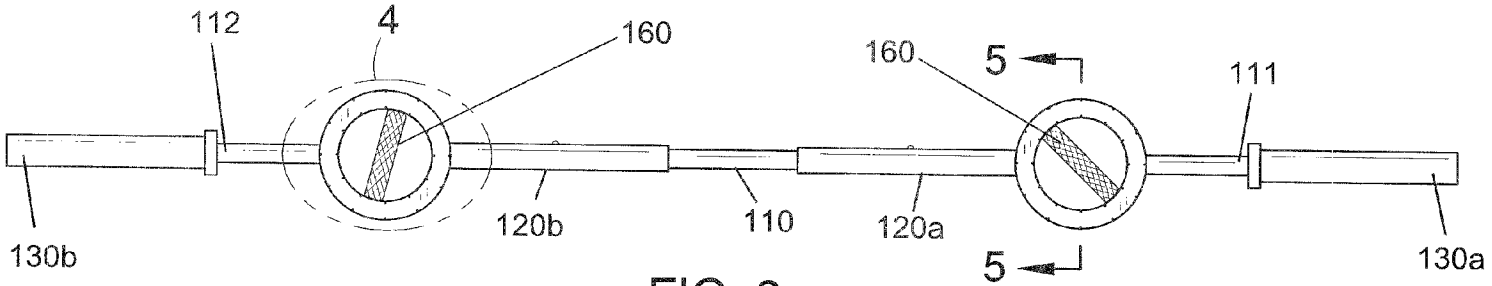
FIG. 3 is a front view of the barbell system of the present invention.
Figure 4:
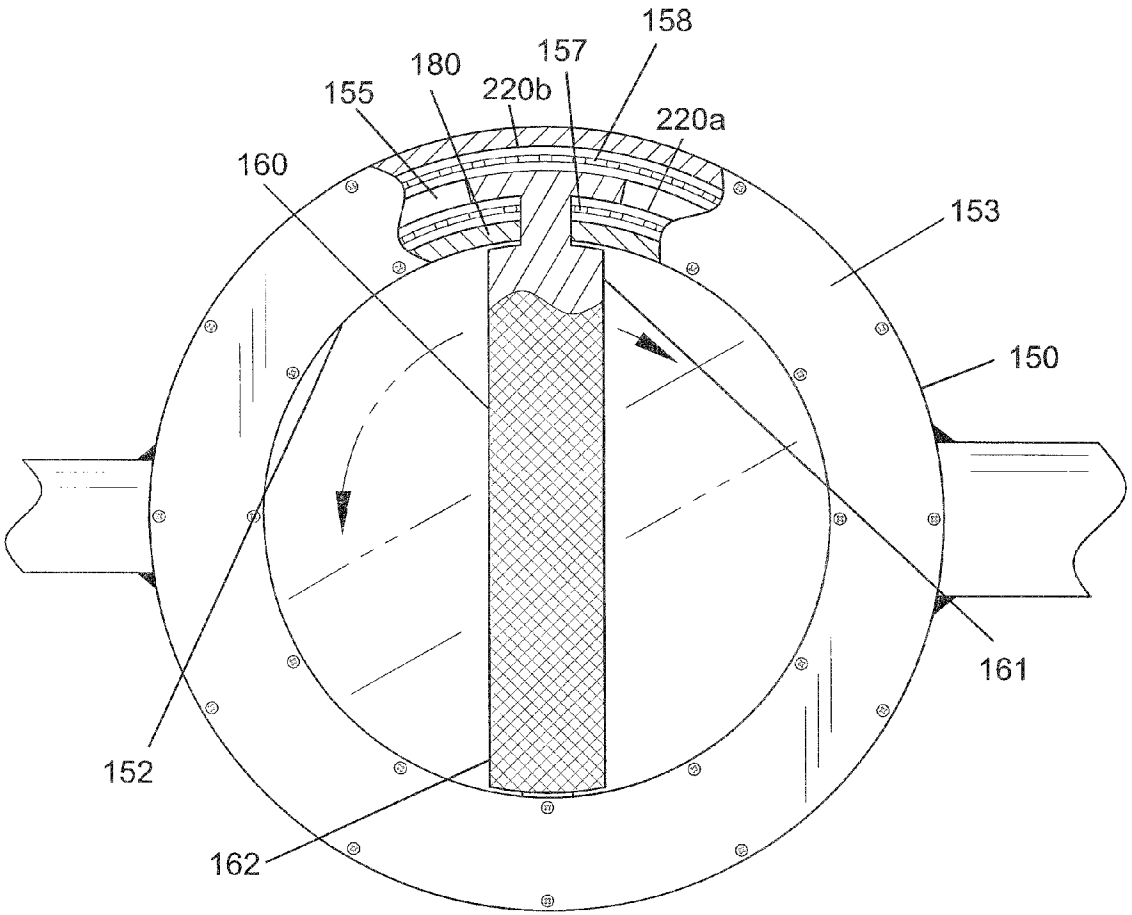
FIG. 4 is an exploded view of the barbell system of the present invention.

Disposed on the outer end 122*a* of the first outer shaft 120*a* is a first retaining ring 150*a*. Disposed on the outer end 122*b* of the second outer shaft 120*b* is a second retaining ring 150*b*. The retaining rings 150 are oriented in the same direction as shown in FIG. 1. The retaining rings 150 each have an outer ring 151 (to which the shafts 120, 130 are attached), an inner ring 152, a front surface 153, and a back surface 154 that together form an inner cavity 155.

Figure 5:
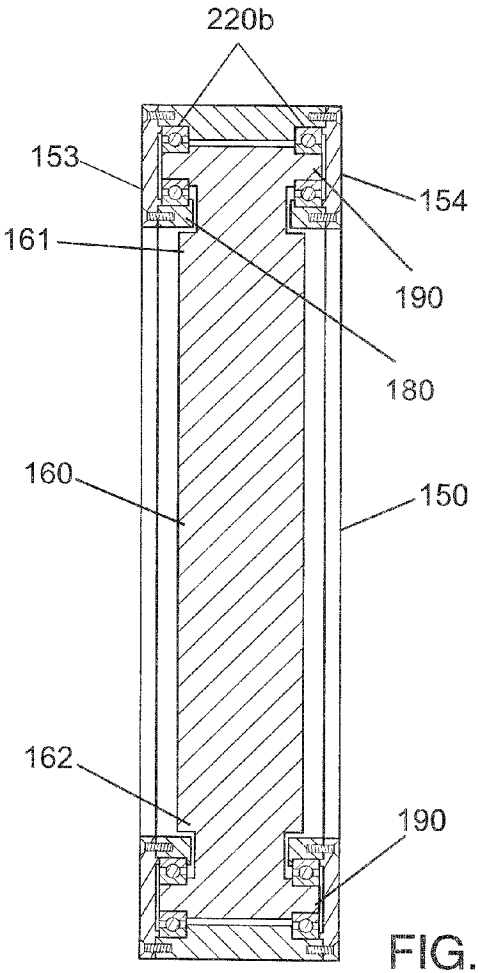
FIG. 5 is a cross-sectional view of FIG. 3 of the barbell system of the present invention.

A track 180 is disposed in the inner ring 152 of the retaining rings 150 extending through the entire circumference of the inner ring 152. A handle shaft 160 having a first end 161 and a second end 162 protrudes through the track 180. For example, as shown in FIG. 5, the first end 161 of the handle shaft 160 protrudes through the track 180 in a first position and the second end 162 of the handle shaft 160 protrudes through the track 180 in a second position opposite the first position. A lip 190 is disposed on both the first end 161 of the handle shaft 160 and on the second end 162 of the handle shaft 160. The lips 190 function to secure the ends 161, 162 of the handle shaft 160 within the inner cavity 155 of the retaining ring 150.

First bearings 220*a* line the internal surface 157 of the inner ring 152 of the retaining ring 150, and the lip 190 engages the first bearings 220*a*. Second bearings 220*b* line the internal surface 158 of the outer ring 151, and the ends 161, 162 of the handle shaft 160 engage the second bearings 220*b*. The handle shaft 160 can rotate 360 degrees around the retaining rings 150 (e.g., within the track 180). The bearings 220 help the handle shafts 160 rotate smoothly within the inner cavity 155 of the retaining rings 150.

A first weight bearing shaft 130*a* is disposed on the first retaining ring 150*a* opposite the first outer shaft 120*a*. A second weight bearing shaft 130*b* is disposed on the second retaining ring 150*b* opposite the second outer shaft 120*b*. The weight bearing shafts 130 are adapted to removably engage a weight 101. The weights 101 may be secured to the weight bearing shafts 130 via a weight attachment means. Weight attachment means are well known to one of ordinary skill in the art (e.g., clips, etc.).

Without wishing to limit the present invention to any theory or mechanism, it is believed that the system 100 of the present invention is advantageous because the system 100 is compatible with Olympic weighted plates, and the shaft is expandable and retractable to allow the system 100 to be used for various exercises. The system 100 may be based on dimensions of an Olympic barbell.

The disclosures of the following U.S. Patents are incorporated in their entirety by reference herein: U.S. Pat. No. 3,384,370; U.S. Pat. No. 4,618,143; U.S. Pat. No. 4,629,184; U.S. Pat. No. 4,822,035; U.S. Pat. No. 5,080,349; U.S. Design Patent No. D535,336.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A barbell system comprising:

(a) a center shaft having a first end and a second end;

(b) a first outer shaft and a second outer shaft, the first end of the center shaft is telescopically received in an inner end of the first outer shaft and the second end of the center shaft is telescopically received in an inner end of the second outer shaft, the system is adjustable in length wherein the first outer shaft can be secured in a position with respect to the center shaft via a first securing mechanism and the second outer shaft can be secured in a position with respect to the center shaft via a second securing mechanism;

(c) a first retaining ring disposed on an outer end of the first outer shaft i20*a* and a second retaining ring disposed on an outer end of the second outer shaft, the retaining rings are oriented in the same direction, each retaining ring comprises an outer ring to which the outer shafts are attached, an inner ring, a front surface, and a back surface that together form an inner cavity, wherein a track is disposed in each inner ring extending through its entire circumference;

(d) a handle shaft having a first end and a second end, the first end protrudes through the track in a first position and the second end of the handle shaft protrudes through the track in a second position opposite the first position, wherein a lip is disposed on both the first end of the handle shaft and on the second end of the handle shaft to secure the ends of the handle shaft within the inner cavity of the retaining ring;

(e) first bearings lining an internal surface of the inner ring of each retaining ring and second bearings lining an internal surface of each outer ring, the lips of the handle shafts engage the first bearings and the ends of the handle shafts engage the second bearings; and (f) a first weight bearing shaft disposed on the first retaining ring opposite the first outer shaft and a second weight bearing shaft disposed on the second retaining ring opposite the second outer shaft, the weight bearing shafts are adapted to removably engage a weight.

2. The system of claim 1, wherein the first securing mechanism or the second securing mechanism comprises a peg-and-aperture mechanism.

* * * * *